US009494020B2

(12) United States Patent
Galloway

(10) Patent No.: US 9,494,020 B2
(45) Date of Patent: Nov. 15, 2016

(54) MULTIPLE DIAMETER EXPANDABLE STRADDLE SYSTEM

(71) Applicant: Gregory G. Galloway, Conroe, TX (US)

(72) Inventor: Gregory G. Galloway, Conroe, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 93 days.

(21) Appl. No.: 14/249,034

(22) Filed: Apr. 9, 2014

(65) Prior Publication Data

US 2015/0292305 A1 Oct. 15, 2015

(51) Int. Cl.
*E21B 43/10* (2006.01)
*E21B 33/128* (2006.01)

(52) U.S. Cl.
CPC ..... *E21B 43/105* (2013.01); *E21B 33/128* (2013.01); *E21B 43/108* (2013.01)

(58) Field of Classification Search
CPC ... E21B 43/105; E21B 43/108; E21B 43/103
See application file for complete search history.

(56) References Cited

U.S. PATENT DOCUMENTS 3,203,483 A * 8/1965 Renic ..... E21B 43/105 166/207
6,457,532 B1 10/2002 Simpson
7,007,760 B2 3/2006 Lohbeck
7,090,025 B2 8/2006 Haugen et al.
7,121,351 B2 * 10/2006 Luke ..... E21B 29/10 166/207
7,124,823 B2 10/2006 Oosterling
7,152,684 B2 12/2006 Harrall et al.
7,325,602 B2 * 2/2008 Cook ..... E21B 43/105 166/207
7,367,389 B2 5/2008 Duggan et al.
7,395,857 B2 7/2008 Hillis
7,699,112 B2 4/2010 Galloway
7,726,395 B2 6/2010 McHardy et al.
7,775,290 B2 8/2010 Brisco et al.
7,793,721 B2 * 9/2010 Watson ..... E21B 43/105 166/118
8,020,625 B2 9/2011 Ring et al.
8,028,749 B2 10/2011 McHardy et al.
9,109,436 B2 * 8/2015 Leighton ..... E21B 29/10
2003/0183395 A1 * 10/2003 Jones ..... E21B 43/08 166/380
2006/0054330 A1 3/2006 Ring et al.
2007/0095532 A1 * 5/2007 Head ..... E21B 29/10 166/277
2013/0140022 A1 * 6/2013 Leighton ..... E21B 29/10 166/277
2014/0027118 A1 * 1/2014 DeLange ..... E21B 23/00 166/297

* cited by examiner

*Primary Examiner* — Shane Bomar
(74) *Attorney, Agent, or Firm* — Patterson & Sheridan, L.L.P.

(57) ABSTRACT

A tubular expansion system is configured to expand a tubular in a wellbore. The expansion system may include an expandable tubular having a lower section and an upper section; a first expansion member configured to expand the lower section; and a second expansion member configured to expand the upper section. The upper section may be expanded to have an inner diameter greater than an inner diameter of the expanded lower section. The second expansion member may be engaged and moved by the first expansion member and/or one or more support members to expand the upper section.

19 Claims, 3 Drawing Sheets

MULTIPLE DIAMETER EXPANDABLE STRADDLE SYSTEM

BACKGROUND OF THE INVENTION

1. Field of the Invention

Embodiments of the invention generally relate to a tubular expansion system.

2. Description of the Related Art

In wellbore applications, a liner hanger may be used to secure a liner to a casing, which extends to the surface of the wellbore. The liner hanger may be located near the base of the casing and may be secured to the inner surface of the casing by an anchor and a packer. The anchor/packer of the liner hanger prevents fluids in the surrounding formation from migrating into the bores of the casing and liner.

Leaks, caused by corrosion or damage for example, may occur across the liner hanger and/or near the base of the casing just above the liner hanger, which require remedial action. Current methods utilize a non-expandable patch that results in a significant inner diameter size reduction. There is no current expandable technology that can seal within both the smaller diameter liner hanger and the larger diameter casing above the liner hanger.

Therefore, there is a need for tubular expansion system that can be used in wellbore applications.

SUMMARY OF THE INVENTION

In one embodiment, an expansion system for expanding a tubular may comprise an expandable tubular having a lower section and an upper section; a first expansion member configured to expand the lower section; and a second expansion member configured to expand the upper section to have an inner diameter greater than an inner diameter of the expanded lower section, wherein the first expansion member is moveable toward the second expansion member during expansion of at least a portion of the lower section, and wherein the first expansion member is moveable with the second expansion member during expansion of at least a portion of the upper section.

In one embodiment, a method of expanding a tubular in a wellbore may comprise expanding a first section of the tubular using a first expansion member; moving the first expansion member toward a second expansion member during expansion of at least a portion of the first section; engaging the second expansion member to expand a second section of the tubular; and expanding the second section of the tubular using the second expansion member, wherein the expanded second section includes an inner diameter greater than an inner diameter of the expanded first section, and wherein the first expansion member is moveable with the second expansion member during expansion of at least a portion of the second section.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Although the embodiments of the invention are described herein with respect to liners and liner hangers, the embodiments of the invention are applicable to any downhole applications involving variable diameter wellbores and/or tubular members. Embodiments of the invention may be used in areas within a wellbore having a change in the inner diameter, such as from a larger inner diameter to a smaller inner diameter, and/or from a smaller inner diameter to a larger inner diameter. For example, a casing string comprised of multiple casings, with some casings having a different casing weight than other casings, may include sections that have a larger or smaller inner diameter than other sections.

Figure 1:
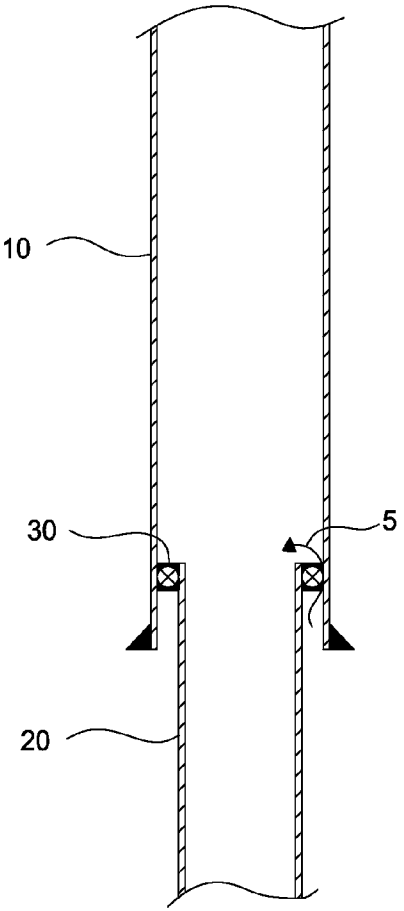
FIG. 1 illustrates a liner secured to a casing by a liner hanger in a wellbore, according to one embodiment.

FIG. 1 illustrates a liner 20 (or other tubular member) secured to a casing 10 (or other tubular member) by a liner hanger 30 in a wellbore. The casing 10 may extend to the surface of the wellbore. The casing 10 has an inner diameter that is greater than the inner diameter of the liner 20. The liner hanger 30 may be positioned near the base of the casing 10, and may be secured to the inner surface of the casing using an anchor and/or a packer, as known in the art.

As illustrated in FIG. 1, a leak 5 may occur across the liner hanger 30, near the base of the casing 20 above the liner hanger 10, and/or in the casing 20 immediately below the liner hanger 30, such that fluids in the surrounding formation migrate into the bores of the casing 10 and the liner 20. The leak 5 may cause multiple hazards in the wellbore and at the surface. A remedial wellbore operation may be conducted to seal the leak 5 and prevent further migration of fluids into the casing 10 and the liner 20.

Figure 2:
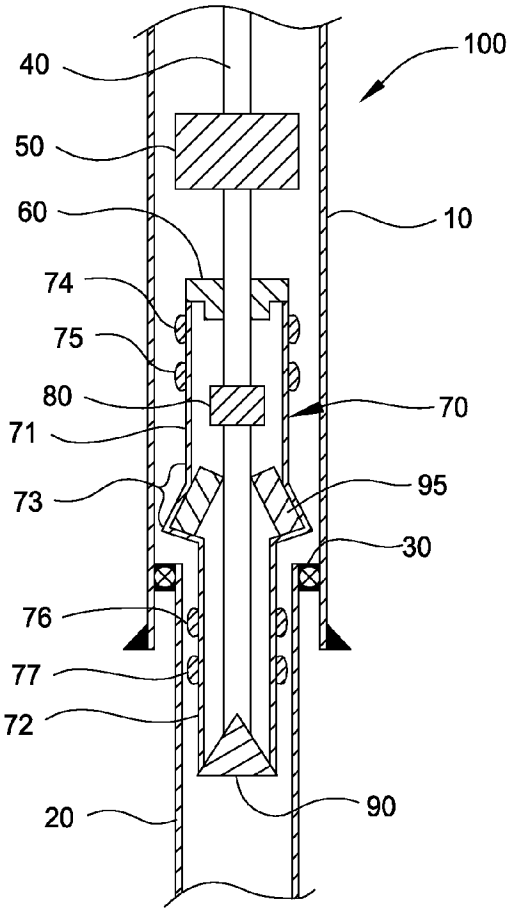
FIG. 2 illustrates an expansion system in the wellbore, according to one embodiment.

FIG. 2 illustrates a tubular expansion system 100 lowered into the wellbore to isolate the leak 5 and prevent further fluid migration into the casing 10 and the liner 20. The system 100 may include a work string 40, an anchor 50, a stop member 60, an expandable tubular 70, a jack 80, a first expansion member 90, and a second expansion member 95.

The work string 40 may be configured to support, lower, and raise the components of the system 100 into and out of the wellbore. The work string 40 may include a string of threaded tubular joints or a coiled tubing string. The work string 40 may have a flow bore for supplying fluids to one or more components of the system 100 and/or for flowing fluids into the wellbore.

The anchor 50 may include any type of anchoring member configured to engage the inner surface of the casing 10 and secure the system 100 in the wellbore. The anchor 50 may include a body having gripping members that are movable radially outward into engagement with the casing 10, and that are moveable radially inward out of engagement with the casing 10. The anchor 50 may be mechanically, hydraulically, pneumatically, and/or electrically actuated into and out of engagement with the casing 10. The anchor 50 may comprise slips, wickers, teeth, swellable elements, inflatable elements, seals, and/or any other components known in the art for anchoring and/or isolating the system in the wellbore.

The stop member 60 may be coupled to the work string 40 and may engage the upper end of the expandable tubular 70. The stop member 60 may be configured to temporarily seal or prevent fluids from entering into the upper end of the expandable tubular 70. The stop member 60 may also be configured prevent upward movement of the expandable tubular 70 when the expandable tubular 70 is initially expanded as further described below.

The expandable tubular 70 may be supported by the work string 40 via the first expansion member 90. The expandable tubular 70 may include a first, lower section 72 for expanding into engagement with the liner 20, and a second, upper section 71 for expanding into engagement with the casing 10. One or more seals 74, 76 may be coupled to the outer surface of the upper and lower sections 71, 72 for forming a sealed engagement between the expandable tubular 70 and the casing 10 and the liner 20, respectively. One or more anchoring members 75, 77 also may be coupled to the upper and lower sections 71, 72 for anchoring the expandable tubular 70 to the casing 10 and the liner 20, respectively. The upper and lower sections 71, 72 may have the same or different inner diameters, and may be formed from the same or different materials. For example, the upper section 71 may have a larger inner diameter than the inner diameter of the lower section 72.

A (crossover/launcher) housing section 73 may be disposed between the upper and lower sections 71, 72 for securing the second expansion member 95 within the expandable tubular 70. The second expansion member 95 may be disposed within the expandable tubular 70, above the lower section 72, prior to expansion of the expandable tubular 70. The housing section 73 may be a thin walled section of the expandable tubular 70. The second expansion member 95 may be secured in the housing section 73 by a releasable/shearable member and/or by a frictional interference fit. The upper, lower, and housing sections 71, 72, 73 may be coupled together using threaded, welded, and/or other types of connections known in the art. The expandable tubular 70 may comprise one or more tubulars coupled together.

The jack 80 may be coupled to work string 40 and disposed within the expandable tubular 70 when lowered into the wellbore. The jack 80 may be configured to move (e.g. pull or push) the first expansion member 90 through the expandable tubular 70 to at least initiate expansion of the lower section 72. The jack 80 may be mechanically, hydraulically, pneumatically, and/or electrically actuated to move the first expansion member 90 a predetermined distance. The jack 80 may be resettable downhole to repeatedly stroke and move the first expansion member 90 through the expandable tubular 70.

The first expansion member 90 may be coupled to the work string 40 and may be configured to expand at least the lower section 72 of the expandable tubular 70. The expandable tubular 70 may be supported by the first expansion member 90, which may be disposed (at least partially) within and/or below the lower section 72. The second expansion member 95 may be secured in the housing section 73. The first expansion member 90 may be moved into engagement with, such as into a profile of, the second expansion member 95 to couple the first expansion member 90 to the second expansion member 95 and to expand the upper section 71 of the expandable tubular 70.

The first expansion member 90 and the second expansion member 95 may include cones that can be forced through the expandable tubular 70 to expand the upper and lower sections 71, 72. The first expansion member 90 and the second expansion member 95 may include fixed diameter, compliant, solid, hollow, and/or segmented cone members. For example, the second expansion member 95 may include a hollow cone or multiple cone segments, and the first expansion member 90 may include a solid cone that can be at least partially inserted into and support the hollow cone or multiple cone segments to expand the upper section 71.

Figure 4:
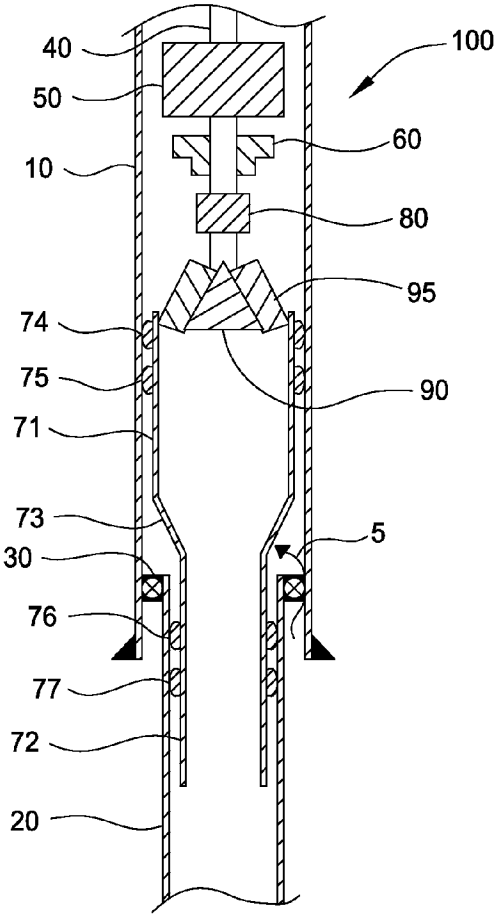
FIG. 4 illustrates the expansion system in a second expansion position, according to one embodiment.
Figure 3:
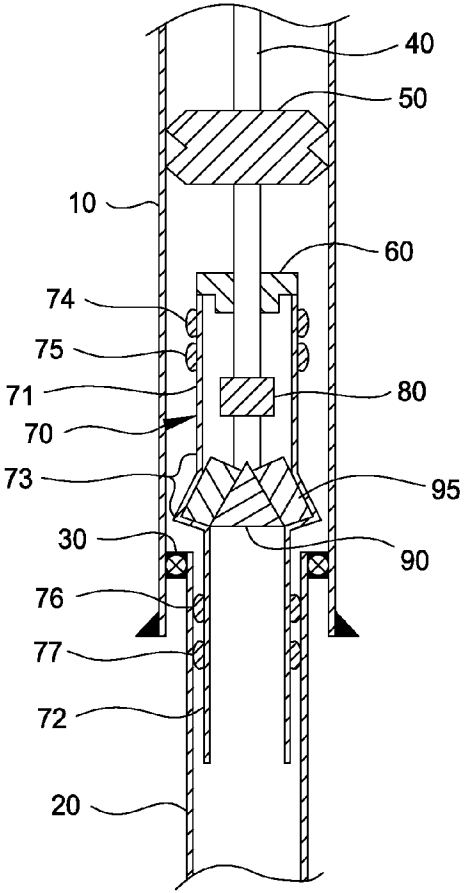
FIG. 3 illustrates the expansion system in a first expansion position, according to one embodiment.

FIGS. 3 and 4 illustrate an operational sequence of the system 100 according to one embodiment.

Referring to FIG. 3, the system 100 may be lowered into a predetermined location within the wellbore. The lower section 72 of the expandable tubular 70 may be at least partially positioned within the liner 20, while the upper section 71 may be at least partially positioned within the casing 10 and/or above the liner hanger 30. The anchor 50 may be actuated into engagement with the casing 10 to secure the system 100 within the wellbore. For example, pressurized fluid may be supplied through the work string 40 to actuate the anchor 50.

When the system 100 is secured in the wellbore, the jack 80 may be actuated to move the first expansion member 90 through the lower section 72 of the expandable tubular 70 to at least initiate expansion. For example, pressurized fluid may be supplied through the work string 40 to actuate the jack 80. The jack 80 may be used to move the first expansion member 90 through substantially the entire length of the lower section 72 to expand the lower section 72 outward into engagement with the liner 20. The seals 76 and/or the anchors 77 may form a sealed and/or anchored engagement between the lower section 72 of the expandable tubular 70 and the liner 20, and may act against any upward force applied to the expandable tubular 70 by the first expansion member 90. The liner stop 60 may also prevent upward movement of the expandable tubular 70 during expansion.

In one embodiment, the jack 80 may be used to move the first expansion member 90 to initiate expansion of the lower section 72. Subsequently, the anchor 50 may be de-actuated from engagement with the casing 10. The work string 40 then may be used to pull the first expansion member 90 through the remainder of the lower section 72 to complete expansion. As stated above, the seals 76 and/or the anchors 77 may engage the liner 20 and act against any upward force applied to the expandable tubular 70 during expansion by the first expansion member 90, as well as the second expansion member 95 further discussed below.

In one embodiment, the first expansion member 90 may be sealed within the lower section 72 of the expandable tubular 70. Pressurized fluid may be supplied through the work string 40 and below the first expansion member 90 to force the first expansion member 90 upward through the lower section 72 for expansion. As stated above, the seals 76 and/or the anchors 77 may engage the liner 20 and act against any upward force applied to the expandable tubular 70 during expansion by the first expansion member 90, as well as the second expansion member 95 further discussed below.

In one embodiment, the system 100 may not include the anchor 80. Rather, the work string 40 and/or pressurized fluid may be used to expand the expandable tubular 70. For example, the seals 76 and/or the anchors 77 may comprise a packer having radially movable setting dogs (as known in the art) that can be independently actuated into engagement with the liner 20, and used to act against any upward force applied to the expandable tubular 70 during expansion by the first expansion member 90 via the work string 40 and/or pressurized fluid.

Referring to FIG. 4, the first expansion member 90 may be moved (via the jack 80, the work string 40, and/or pressurized fluid) into engagement with the second expansion member 95. The first expansion member 90 may be moved into a profile of or inserted into the second expansion member 95 to couple the expansion members 90, 95 together. The housing section 73 may also be expanded during or after the first and second expansion members 90, 95 are connected with each other. The first and second expansion members 90, 95 may then be moved together through the upper section 71 to expand the upper section 71 into engagement with the casing 10.

The second expansion member 95 is supported by the first expansion member 90 and moves through the upper section 71 to expand the upper section 71 into engagement with the casing 10. Similar to the first expansion member 90, the second expansion member 95 may be moved through at least part of or substantially the entire length of the upper section 71 using the jack 80, the work string 40, and/or pressurized fluid to expand the upper section 71. The anchor 50 may be de-actuated from engagement with the casing 10. The seals 74 and/or the anchors 75 similarly may form a sealed and/or anchored engagement between the upper section 71 of the expandable tubular 70 and the casing 10.

When expansion of the expandable tubular 70 is complete, the work string 40 may be used to remove and retrieve the anchor 50, the liner stop 60, the jack 80, the first expansion member 90, and the second expansion member 95 from the wellbore. After expansion of the expandable tubular 70, the upper section 71 has a larger inner diameter than the inner diameter of the lower section 72. The seals 74, 76 isolate the leak 5 and prevent further migration of fluids into the casing 10 and/or liner 20. The larger inner diameter, expanded upper section 71 provides the ability to run downhole tools, such as packers, plugs, etc., in the lower end of the casing 10, which would not be possible with an inner diameter reduction using current conventional methods.

In one embodiment, the first expansion member 90 and/or the second expansion member 95 may be compliant expansion members that can comply and deform if a restriction (or other type of obstruction) is encountered within the wellbore when expanding the expandable tubular 70. In one embodiment, the second expansion member 95 may be releasably coupled to the first expansion member 90 such that the second expansion member 95 can be sheared or released from engagement with the first expansion member 90 if a restriction (or other type of obstruction) is encountered within the wellbore when expanding the upper section 71.

Although illustrated in a bottom-up expansion operation, the embodiments of the invention can be used to expand the expandable tubular 70 in a top-down expansion operation. In one embodiment, the first expansion member 90 may be used to expand the upper section 71 first, and then moved into engagement with the second expansion member 95 to subsequently expand the lower section 72. The lower section 72 may be expanded to have an inner diameter greater than the inner diameter of the expanded upper section 71. The first and second expansion members 90, 95 can then be retrieved together from the expanded tubular 70. In one embodiment, the first and second expansion members 90, 95 may be coupled together initially, and can be used to expand the upper section 71 first. When encountering the lower section 72, the second expansion member 95 can be released from engagement with the first expansion member 95. The lower section 72 can then be expanded using only the first expansion member 95. The lower section 72 may be expanded to have an inner diameter less than the inner diameter of the expanded upper section 71. The first expansion member 90 can be retrieved when pulling the second expansion member 95 out of the expanded tubular 70. In one embodiment, the first and second expansion members 90, 95 can be moved through the expandable tubular 70 by setting down weight via the work string 40, using the jack 80, and/or using pressurized fluid.

Figure 5:
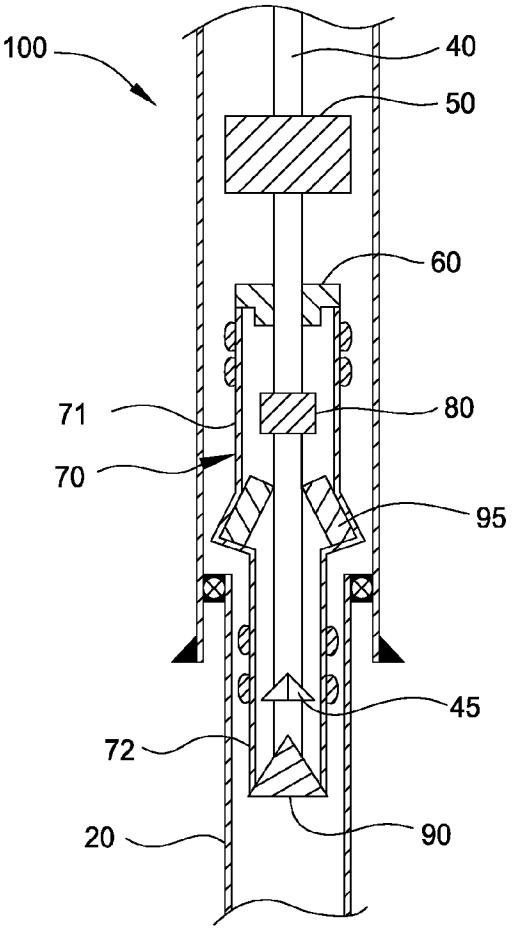
FIG. 5 illustrates the expansion system in the wellbore, according to one embodiment.

FIG. 5 illustrates the tubular expansion system 100 according to another embodiment. The system 100 includes one or more support members 45. The support members 45 may be configured to engage and move the second expansion member 95 through the upper section 71 to expand the expandable tubular 70. In one embodiment, the support members 45 may be integral with or coupled to the work string 40. In one embodiment, the support members 45 may be integral with or coupled to the first expansion member 90.

The support member 45 may be a shoulder or other enlarged outer diameter area of the work string 40 and/or the first expansion member 90. The support members 45 may be (mechanically, hydraulically, pneumatically) extended and/or retracted relative to the work string 40 and/or the first expansion member 90 as needed to engage and disengage from the second expansion member 95. The support members 45 may be biased radially outward (such as by one or more springs) into engagement with the second expansion member 95.

Figure 7:
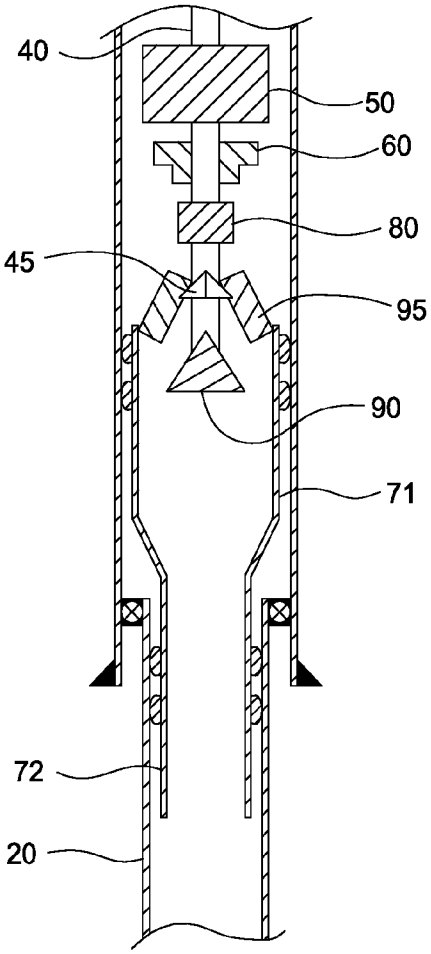
FIG. 7 illustrates the expansion system in a second expansion position, according to one embodiment.
Figure 6:
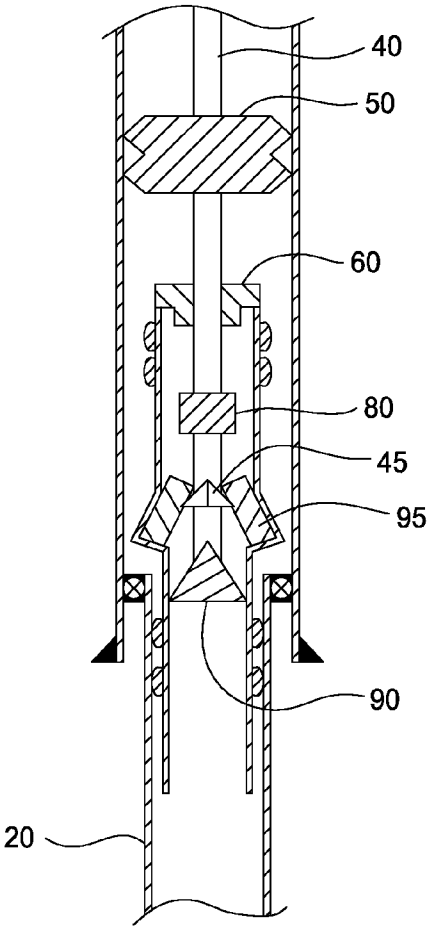
FIG. 6 illustrates the expansion system in a first expansion position, according to one embodiment.

Referring to FIGS. 6 and 7, a force is applied to the work string 40 and/or the first expansion member 90 to move the first expansion member 90 through the lower section 72 relative to the second expansion member 95. The lower section 72 is expanded into engagement with the liner 20 as described above. The support members 45 move with the work string 40 and/or the first expansion member 90 relative to and in a direction toward the second expansion member 95. The support members 45 may be spaced relative to the first expansion member 90 such that they engage and move the second expansion member 95 through the upper section 71. The support members 45 move the second expansion member 95 through the upper section 71 to expand the upper section 71. The first expansion member 90 moves with the second expansion member 95 as the second expansion member 95 expands (at least a portion of) the upper section 71.

The support members 45 may be spaced relative to the first expansion member 90 such that they move the second expansion member 95 to expand the upper section 71 after the first expansion member 90 completes expansion of the lower section 72. The support members 45 may engage and move the second expansion member 95, such as movement within the housing section 73, while the first expansion member 90 completes expansion of the lower section 72 but prior to beginning expansion of the upper section 71. Alternatively, the support members 45 may be spaced relative to the first expansion member 90 such that they move the second expansion member 95 to expand the upper section 71 before or at substantially the same time that the first expansion member 90 completes expansion of the lower section 70. When expansion of the expandable tubular 70 is complete, the work string 40 may be used to remove and retrieve the anchor 50, the liner stop 60, the jack 80, the first expansion member 90, the second expansion member 95, and the support members 45 from the wellbore.

While the foregoing is directed to embodiments of the invention, other and further embodiments of the invention may be devised without departing from the basic scope thereof, and the scope thereof is determined by the claims that follow.

The invention claimed is:

1. An expansion system for expanding a tubular in a wellbore, comprising:

an expandable tubular having a lower section and an upper section;

a first expansion member configured to expand the lower section; and a second expansion member configured to expand the upper section to have an inner diameter greater than an inner diameter of the expanded lower section, wherein the first expansion member is moveable toward the second expansion member during expansion of at least a portion of the lower section while the second expansion member remains stationary, and wherein the first expansion member is moveable with the second expansion member during expansion of at least a portion of the upper section.

2. The system of claim 1, wherein the first expansion member includes a cone or cone segments.

3. The system of claim 1, wherein the second expansion member includes a cone or cone segments.

4. The system of claim 1, wherein the second expansion member is disposed within the expandable tubular above the lower section prior to expansion of the expandable tubular.

5. The system of claim 1, further comprising a jack configured to move the first expansion member through the lower section.

6. The system of claim 1, further comprising a work string configured to move the first and second expansion members through the upper section.

7. The system of claim 1, further comprising one or more seals or anchors coupled to an outer surface of the expandable tubular.

8. The system of claim 1, further comprising an anchor for securing the system within the wellbore.

9. The system of claim 1, further comprising one or more support members configured to engage and move the second expansion member through the upper section.

10. A method of expanding a tubular in a wellbore, comprising:

expanding a first section of the tubular using a first expansion member;

moving the first expansion member toward a second expansion member during expansion of at least a portion of the first section while the second expansion member remains stationary;

engaging the second expansion member to expand a second section of the tubular; and expanding the second section of the tubular using the second expansion member, wherein the expanded second section includes an inner diameter greater than an inner diameter of the expanded first section, and wherein the first expansion member is moveable with the second expansion member during expansion of at least a portion of the second section.

11. The method of claim 10, wherein the first expansion member includes a cone or cone segments.

12. The method of claim 10, wherein the second expansion member includes a cone or cone segments.

13. The method of claim 10, wherein the first section is expanded into engagement with a tubular member having an inner diameter that is less than another tubular member that the second section is expanded into engagement with.

14. The method of claim 10, further comprising moving the first expansion member through the lower section using at least one of a jack, a work string, and pressurized fluid.

15. The method of claim 10, further comprising moving the first and second expansion members through the upper section using at least one of a jack, a work string, and pressurized fluid.

16. The method of claim 10, further comprising anchoring the tubular within the wellbore.

17. The method of claim 10, further comprising moving one or more support members into engagement with the second expansion member, and moving the second expansion member through the second section using the support members.

18. The method of claim 10, further comprising expanding the tubular from the bottom up.

19. The method of claim 10, further comprising expanding the tubular from the top down.

* * * * *